US007343907B2

(12) United States Patent
Raab et al.

(10) Patent No.: US 7,343,907 B2
(45) Date of Patent: Mar. 18, 2008

(54) CRANKCASE LOWER PART

(75) Inventors: Gottfried Raab, Perg (AT); Heinz Povolny, Losenstein (AT)

(73) Assignee: MAN Nutzfahrzeuge Osterreich AG (AT)

( * ) Notice: Subject to any disclaimer, the term of this patent is extended or adjusted under 35 U.S.C. 154(b) by 50 days.

(21) Appl. No.: 11/410,801

(22) Filed: Apr. 25, 2006

(65) Prior Publication Data

US 2006/0236691 A1 Oct. 26, 2006

(30) Foreign Application Priority Data

Apr. 25, 2005 (AT) ..... A 685/2005

(51) Int. Cl.
*F02B 33/00* (2006.01)
*F02F 7/00* (2006.01)

(52) U.S. Cl. ..... 123/563; 123/196 R; 123/184.22; 123/559.1; 123/195 C; 123/196 AB; 123/568.12; 123/562; 60/612

(58) Field of Classification Search ..... 123/559.1, 123/184.2, 563, 562, 612, 572, 568.12, 195 C, 123/196 R, 196 A, 196 B, 196 AB, 184.22
See application file for complete search history.

(56) References Cited

U.S. PATENT DOCUMENTS

| | | | | |
|---|---|---|---|---|
| 4,267,812 | A * | 5/1981 | Aula et al. | 123/568.12 |
| 6,311,678 | B1 * | 11/2001 | Lepoutre | 123/568.12 |
| 6,488,003 | B2 * | 12/2002 | Karlsson | 123/196 AB |
| 6,604,514 | B1 * | 8/2003 | Englund et al. | 123/559.1 |
| 6,817,335 | B2 * | 11/2004 | Groddeck et al. | 123/195 C |
| 6,910,525 | B2 * | 6/2005 | Gokan et al. | 123/563 |
| 6,923,166 | B2 * | 8/2005 | Barnes et al. | 123/559.1 |
| 7,191,769 | B2 * | 3/2007 | Raab et al. | 123/563 |
| 7,267,093 | B2 * | 9/2007 | Huster et al. | 123/196 R |
| 2006/0213476 | A1 * | 9/2006 | Ruetz | 123/195 C |
| 2007/0000471 | A1 * | 1/2007 | Huster et al. | 123/196 R |

* cited by examiner

*Primary Examiner*—Thomas Denion
*Assistant Examiner*—Mary A Davis
(74) *Attorney, Agent, or Firm*—Robert W. Becker; Robert W. Becker & Assoc.

(57) ABSTRACT

A crankcase lower part for a supercharged internal combustion engine, wherein the crankcase lower part extends about a space below the crankshaft. The crankshaft lower part comprises an intercooler, which is cooled by coolant, and/or a charge air intermediate cooler, which is cooled by a coolant. The intercooler and/or the charge air intermediate cooler is integrated into the crankcase lower part.

11 Claims, 8 Drawing Sheets

C-C'
37

A-A'
24
36
38
37
38
37

B-B
24
27
39'
26
37
C
C'
20
25
37
39
28
20

CRANKCASE LOWER PART

BACKGROUND OF THE INVENTION

The object of the present invention is a crankcase lower part for a supercharged internal combustion engine having a liquid cooled intercooler and/or charge air intermediate cooler, the crankcase lower part enclosing the space below the crankshaft.

Internal combustion engines of the above-mentioned type typically have a cylinder head, a crankcase upper part and a crankcase lower part as the main components. The gas exchange valves, the injection nozzles, and the particular actuating devices are located in the cylinder head, which terminates the combustion chambers of the internal combustion engine on top. The cylinders having the pistons positioned therein and the crankshaft connected via connecting rods to the pistons are positioned in the crankcase upper part The crankcase lower part adjoining the crankcase upper part encloses the space below the crankshaft and comprises at least one oil sump used as a collection chamber for the engine oil. For reasons of stability, the crankcase lower part may be implemented in two parts in such a way that a yoke plate or a bearing plate is provided between crankcase upper part and oil sump. While the yoke plate is only used for reinforcing the crankcase upper part, the bearing covers for the crankshaft bearings are also molded onto the bearing plate, which is also referred to as a "bed plate". An arrangement having a yoke plate is known, for example, from EP 0 663 522 Al, while EP 0 076 474 Al describes an arrangement having a bearing plate.

The terms cited above and in the related art: (crankcase) upper part and (crankcase) lower part, as well as statements such as "below the crank-shaft" etc. are not to be understood in a geodetic way in this context, but rather relate to the movement direction of the piston to the upper and/or lower dead center. Therefore, downward is in the direction in which the piston moves toward the lower dead center. This difference is important because the object of the present invention is applicable for internal combustion engines installed at any arbitrary angle of inclination.

As already noted, internal combustion engines of the type described above, particularly diesel internal combustion engines, are equipped with an arrangement for compressing the charge air; in this context one also refers to supercharging of the internal combustion engine. In this case, the supercharging may be single-stage or also multistage, particularly dual-stage. An internal combustion engine having dual-stage supercharging is known, for example, from DE 19961610. To reduce the charge air temperature, the arrangement described therein has an intercooler positioned after the first compressor stage as an intermediate cooler, whose object is to reduce the temperature level of the charge air already after the low-pressure stage, in order to thus increase the efficiency of the internal combustion engine and reduce the exhaust gas emissions. A further intercooler is typically positioned after the high-pressure compressor. It remains open how the intercoolers according to DE 19961610 are implemented.

In internal combustion engines of the type cited at the beginning positioned in vehicles, in addition to the problem of the required efficient cooling of the charge air, the problem exists that the amount of space available for installation is extremely small. Furthermore, for optimum throughput of charge air, it is required that the charge air be opposed with the smallest possible fluidic resistance.

It is therefore an object of the present invention to provide an intercooler which ensures efficient cooling of the charge air, takes the tight spatial conditions, particularly between low-pressure and high-pressure compressors, into consideration, and opposes the charge air with the smallest possible flow resistance.

SUMMARY OF THE INVENTION

This object is achieved by a crankcase lower part that comprises an intercooler, which is cooled by a coolant and/or a charged air intermediate cooler, which is cooled by a coolant, wherein the intercooler and/or intermediate cooler is integrated into the crankcase lower part.

The integration according to the present invention of the intercooler and/or the charge air intermediate cooler into the crankcase lower part advantageously uses an installation space present in internal combustion engines of the type described which has been largely unexploited until now and thus minimizes the space required for the intercooler and/or the charge air intermediate cooler. It suggests itself in this case to combine the construction of the intercooler and/or the charge air intermediate cooler with that of the crankcase lower part as well; this may advantageously be performed by attaching the intercooler and/or the charge air intermediate cooler to the oil sump or, if it is provided, to a yoke plate or a bearing plate. In particular, it is advantageous to implement the intercooler and/or the charge air intermediate cooler at least partially in one piece with the oil sump, the yoke plate, or the bearing plate.

The intercooler and/or the charge air intermediate cooler is advantageously subdivided into a first chamber guiding the coolant liquid and a second chamber guiding the charge air and sealed in relation to the first chamber, the first chamber being incorporated into a coolant liquid loop via a coolant liquid intake and a coolant liquid outlet, and the second chamber being connected via a charge air supply line to the pressure side of a compressor providing the charge air and via a charge air discharge line to a charge air header pipe or the intake side of a further compressor. The heat exchange area of the wall separating the first chamber from the second chamber is advantageously as large as possible in this case.

Furthermore, it is advantageous to implement the intercooler and/or the charge air intermediate cooler as tubular in order to minimize the flow resistance opposing the charge air as much as possible. In this case, the arrangement may advantageously be subdivided into an external pipe and a preferably tubular insert,; external pipe and insert may be used either as a coolant guide or as a charge air guide in this case. The external pipes may advantageously be attached to the oil sump, the yoke plate, or the bearing plate or may be implemented in one piece therewith.

In connection with the integration of the intercooler(s) into the crankcase lower part, in internal combustion engines having exhaust gas recirculation (EGR) and cooling of the recirculated exhaust gas, it suggests itself that the EGR cooler also advantageously be integrated into the crankcase lower part.

To guide the charge air from a first side of the internal combustion engine to a second different side, it is also possible to integrate one or more charge air lines without a cooling function into the crankcase lower part in order to thus avoid guiding charge air lines around the engine block. This is especially advantageous because the crank-case lower part does not have many functional parts which would obstruct guiding through of the charge air pipes.

BRIEF DESCRIPTION OF THE DRAWINGS

Examples of the arrangement according to the present invention are explained in greater detail in the following with the aid of the drawings, in which.

DESCRIPTION OF SPECIFIC EMBODIMENTS

Figure 1:
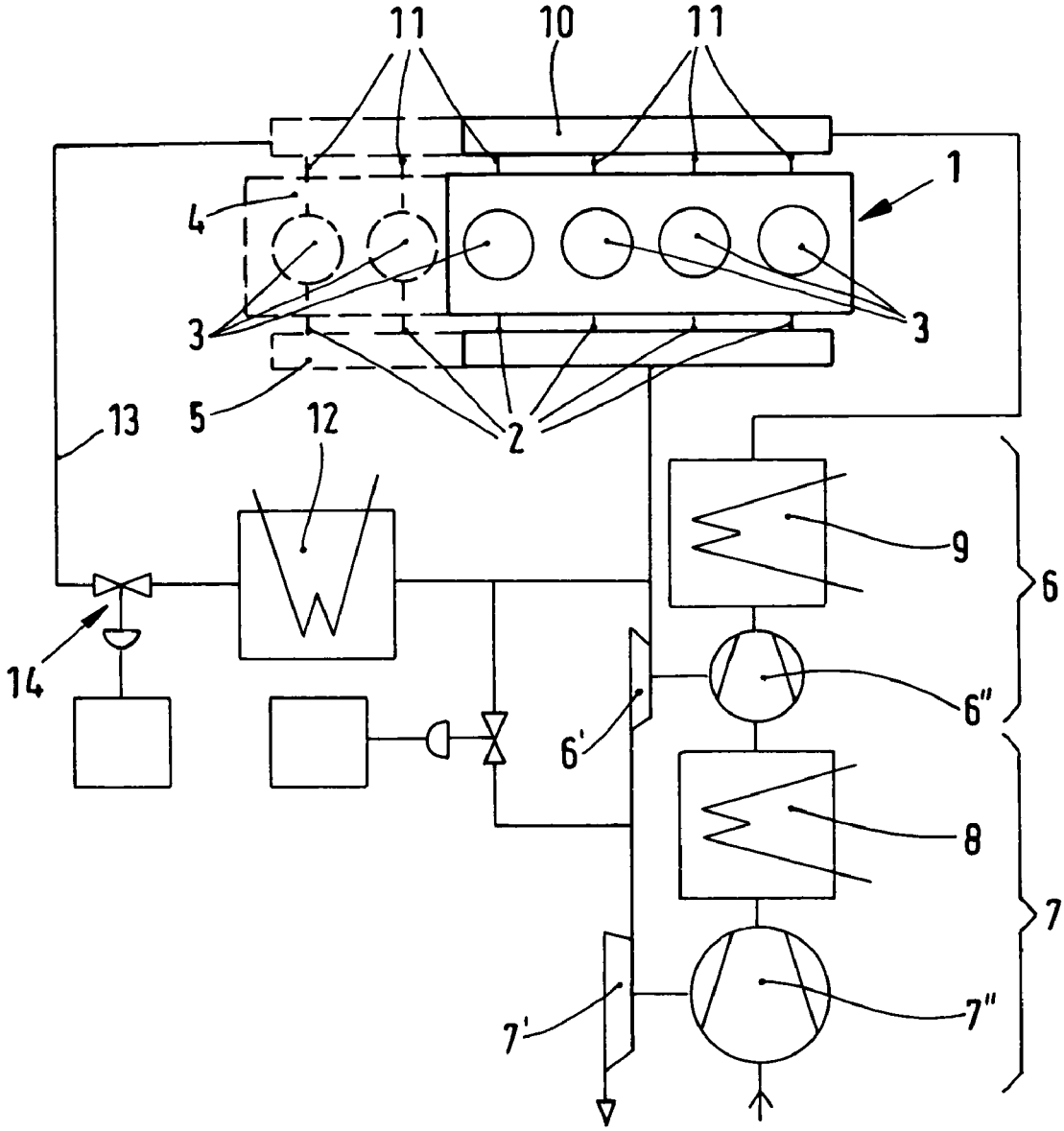
FIG. 1 shows a schematic illustration of an internal combustion engine having dual-stage supercharging.

The internal combustion engine 1 shown in a schematic illustration in FIG. 1 has an exhaust gas header pipe 5 connected via exhaust manifold 2 to the combustion chambers 3 of the engine block 4; the header pipe 5 guides the combustion gases over the turbine wheel 6' of the high-pressure compressor stage 6 and the turbine wheel 7' of the low-pressure compressor stage 7 and, via these, drives the compressor 6" of the high-pressure compressor stage 6 and the compressor 7" of the low-pressure compressor stage 7. The charge air is suctioned by the compressor 7" of the low-pressure compressor stage 7 via an air filter (not shown), compressed, and then reaches the compressor 6" of the high-pressure compressor stage 6 via an intermediate cooler 8. The second compression of the charge air occurs there, which then reaches the intake pipe 10 of the internal combustion engine 1 via a further intercooler 9 and/or reaches the combustion chambers 3 of the engine block 4 via the intake header 11.

The object of the intermediate cooler 8 and the intercooler 9 is to cool the charge air heated by the compressor procedure as effectively as possible to optimize the efficiency, without negatively influencing the air throughput Furthermore, an exhaust gas recirculation line 13 is provided, which connects the exhaust gas header pipe 5 to the intake pipe 10 via an EGR cooler 12 for cooling the recirculated exhaust gas and a control valve 14 for regulating the quantity of recirculated exhaust gas. The EGR cooler 12 is to prevent the charge air from being heated by the recirculated exhaust gas.

In the following, it is shown on the basis of several examples how the charge air intermediate cooler and/or the intercooler and/or the EGR cooler may be integrated into the crankcase lower part. These are merely schematic illustrations to illustrate the essential aspects of the present invention.

Figure 2:
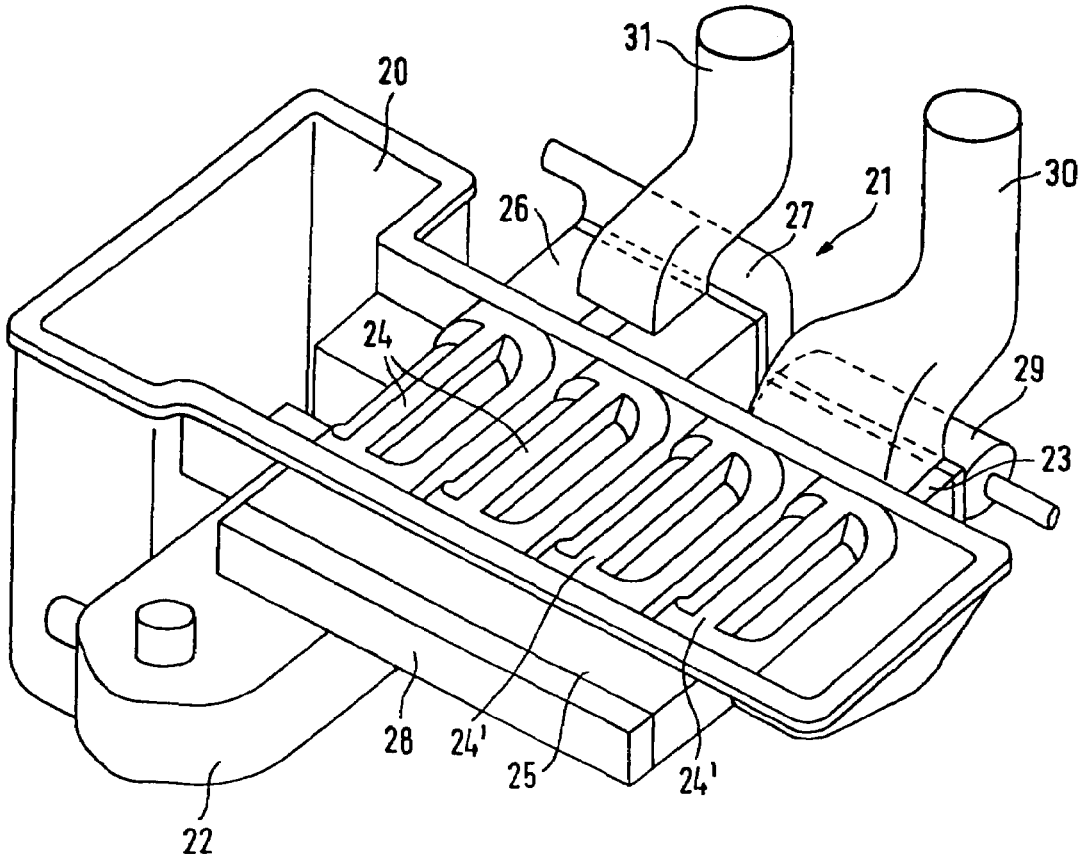
FIG. 2 shows an oil sump having integrated charge air intermediate cooler and intercooler in a perspective illustration.
Figure 3:
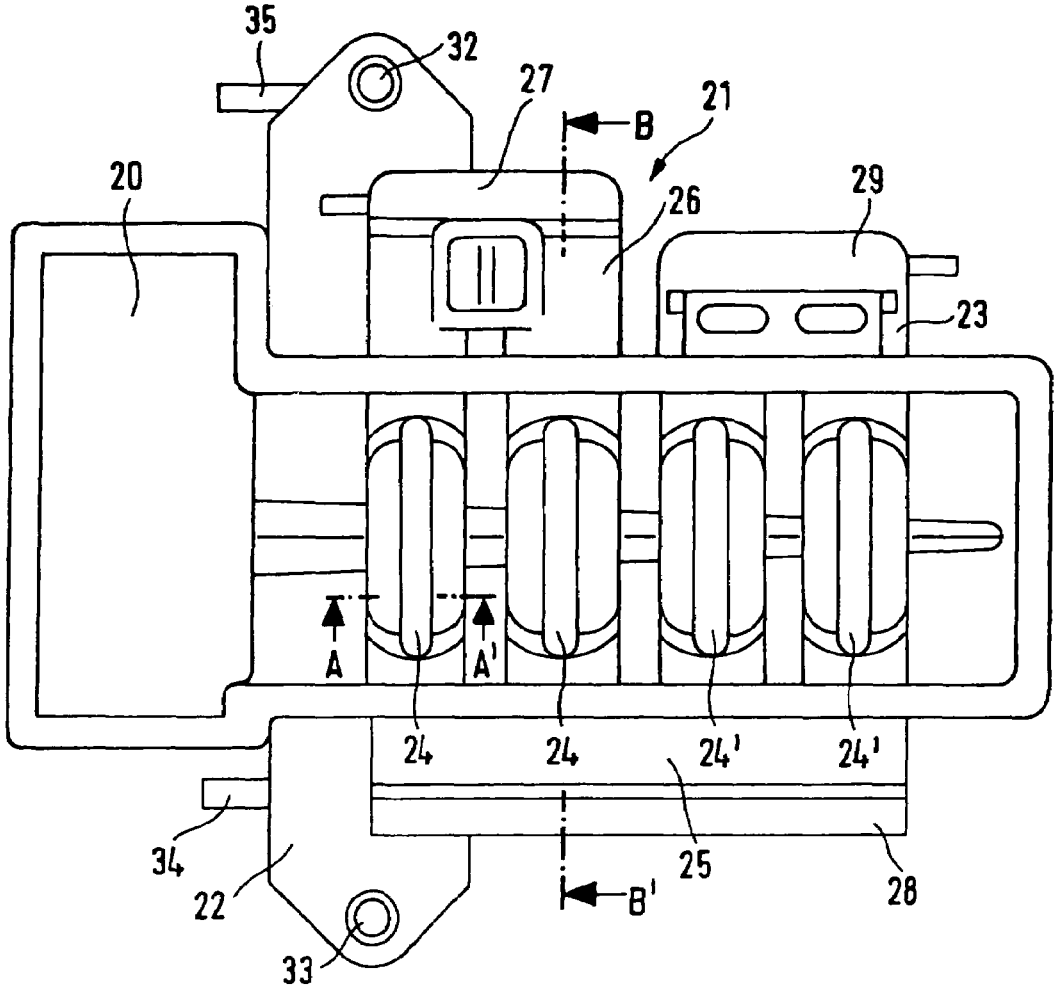
FIG. 3 shows the oil sump from FIG. 2 in a top view.

Firstly, an arrangement is shown in FIGS. 2 and 3, in which a charge air intermediate cooler and an intercooler are integrated into the oil sump forming the crankcase lower part. Identical components are provided with identical reference numbers in both figures.

FIG. 2 shows a perspective illustration and FIG. 3 shows a top view of an oil sump 20 forming the crankcase lower part, in which a charge air intermediate cooler 21 and an intercooler 22 are integrated. The charge air intermediate cooler 21 essentially comprises a charge air supply connecting part 23 positioned on a first long side of the oil sump 20, from which two charge air pipes 24', which guide the charge air, traverse the oil sump to its second long side. A charge air collection chamber 25 is positioned on the second long side, which combines the charge air pipes 24' into one draft and connects them to charge air pipes 24, which traverse the oil sump 20 in the direction toward its first long side originating from the second long side, where they open into a charge air discharge connecting part 26.

First cooling inserts—not visible in FIG. 2—are located in the interior of the charge air pipes 24, which connect a coolant inflow chamber 27, positioned on the first side of the oil sump 20 at the charge air discharge connecting part 26, to a coolant collection chamber 28 on the diametrically opposite second side of the oil sump. Second cooling inserts—also not visible in FIG. 2—lead, in the interior of the charge air pipes 24', from this coolant collection chamber 28 back to a coolant outflow chamber 29 positioned on the first side of the oil sump 20 at the charge air supply connecting part 23.

Through the arrangement described above, the charge air compressed by a low-pressure compressor (7" FIG. 1) flows via a charge air supply line 30 into the charge air supply connecting part 23 and via this and the charge air pipes 24' into the charge air collection chamber 25. From there, the charge air reaches a high-pressure compressor (6" FIG. 1) through the charge air pipes 24, the charge air discharge connecting part 26, and a charge air discharge line 31. The charge air is cooled in the counterflow principle in that coolant from a cooling system (not shown) flows via the coolant inflow chamber 27, the first cooling inserts, the coolant collection chamber 28, and the second coolant inserts to the coolant outflow chamber 29 and from there returns back into the cooling system.

The charge air pipes 24, 24' described above and also the charge air supply connecting part 23, the charge air collection chamber 25, and the charge air discharge connecting part 26 may be produced in one piece with the oil sump using casting, but it is also conceivable that the arrangement is completely or partially constructed from individual parts.

The intercooler 22 shown in FIGS. 2 and 3 is used, as already described in connection with FIG. 1, for the purpose of cooling charge air compressed again by the high-pressure compressor (6" FIG. 1) and heated at the same time. The intercooler 22 is positioned below the oil sump 20 in its flat part, attached thereto in such a way that it leads from the first long side of the oil sump 20 under it through to the second side of the oil sump 20. The charge air provided by the high-pressure compressor (6" FIG. 1) is supplied on the first long side of the oil sump 20 to the intercooler 22 via a charge air connection 32 and through this reaches the second long side of the oil sump 20, where a charge air discharge 33 is positioned at the intercooler 22, from which the charge air reaches the intake pipe (10 FIG. 1) via a connecting pipe. A heat exchanger (not visible), which coolant flows through, is positioned in the intercooler 22, which is connected via a coolant inlet 34 and a coolant outlet 35 to a cooling system (not shown).

The arrangement described above in connection with FIGS. 2 and 3 may, of course, be altered so that the intermediate cooler 21 may also assume the function of an intercooler, particularly with single stage supercharging, but the intercooler 22 may also assume the function of a charge air intermediate cooler.

Figures 4, 5, 6:
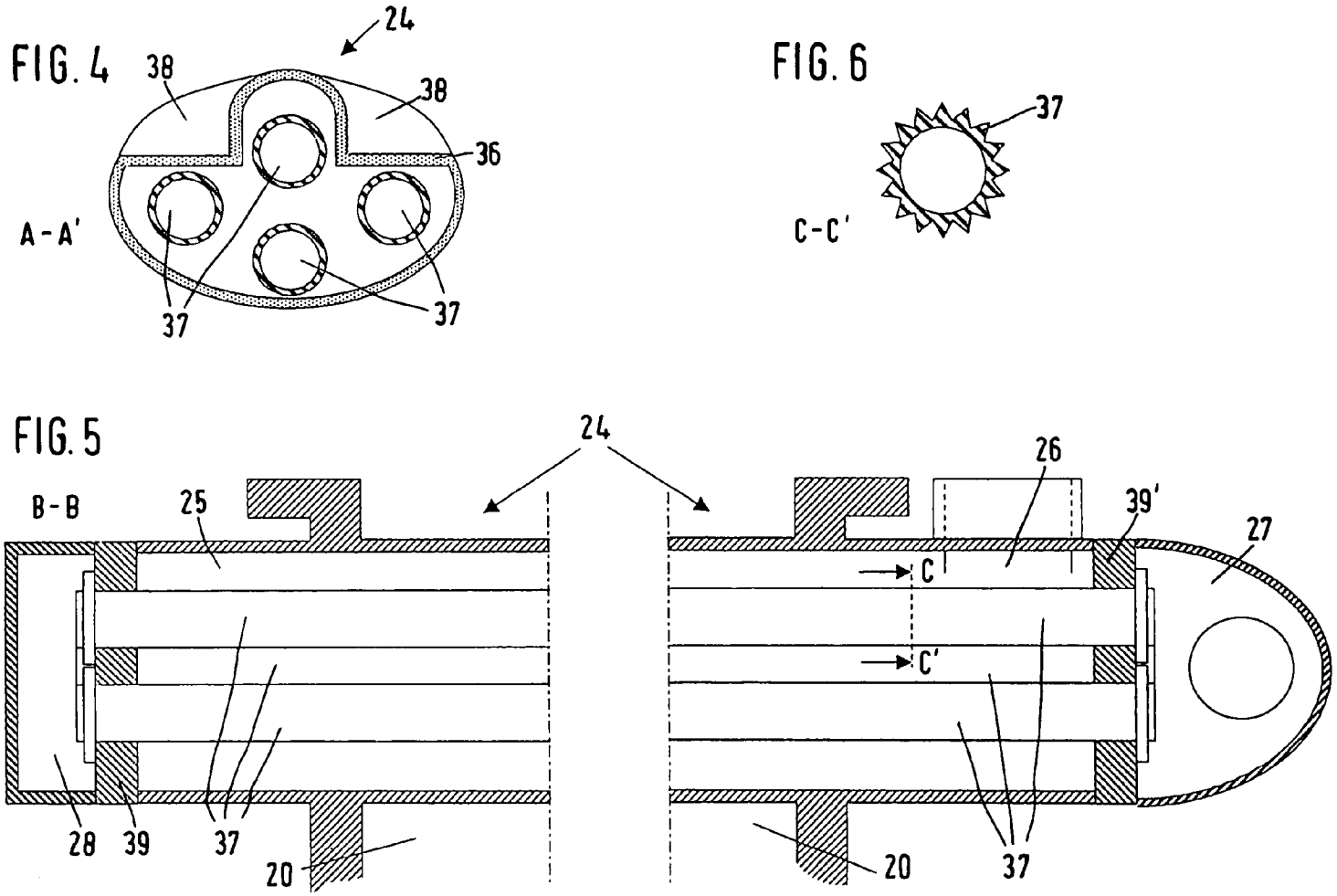
FIG. 4 shows a sectional illustration along the line A-A' in FIG. 3.
FIG. 5 shows a sectional illustration along the line B-B' in FIG. 3.
FIG. 6 shows a sectional illustration along the line C-C' in FIG. 5.

To illustrate the internal construction of the charge air intermediate cooler 21 described above in connection with FIGS. 2 and 3, sections are taken through the illustration in FIG. 3 along lines A-A' and B-B'. FIG. 4 shows a sectional illustration along the line A-A' through the charge air pipe 24. The wall 36 of the charge air pipe encloses a cooling insert comprising four pipes 37, which coolant flows through. The space between the pipes 37 and the wall 36 has the charge air flowing through it, so that the largest possible surface results between the area the coolant flows through and the area the charge air flows through and, in addition, the charge air is not opposed by any unnecessary flow obstruction. The charge air pipe 24 is contoured in the areas 38 in this case in such a way that the crankshaft (not shown) may dip into these areas 38 as it revolves, as a result of which the overall height of the arrangement is minimized.

FIG. 5 shows, in a longitudinal section along line B-B', the charge air pipe 24, which is implemented in one piece with the oil sump 20, the charge air discharge connecting part 26 and the charge air collection chamber 25. The coolant inflow chamber 27 is positioned at the charge air discharge connecting part 26, while the coolant collection chamber 28 is positioned at the charge air collection chamber 25. The charge air pipe 24, the charge air discharge connecting part 26, and the charge air collection chamber 25 are penetrated by the pipes 37 in the longitudinal direction, the pipes 37 being held via holding plates 39, 39'. The holding plates 39, 39' simultaneously form the closure cap for the charge air supply connecting part 26 to the coolant inflow chamber 27 and for the charge air collection chamber 25 to the coolant collection chamber 28. Two areas delimited in relation to one another result through the construction described above, the area which the charge air flows through, comprising charge air collection chamber 25, charge air pipe 24, and charge air discharge connecting part 26 and, in addition, the area the coolant flows through, which comprises the coolant inflow chamber 27, the pipes 37, and the coolant collection chamber 28.

For better heat absorption by the pipes 37 through which the coolant flows, these pipes may be implemented as profiled as shown in FIG. 6 in a sectional illustration along line C-C', in order to make the surface of the wall of the pipes 37 in contact with the charge air as large as possible and thus favor the heat transfer.

Figure 7:
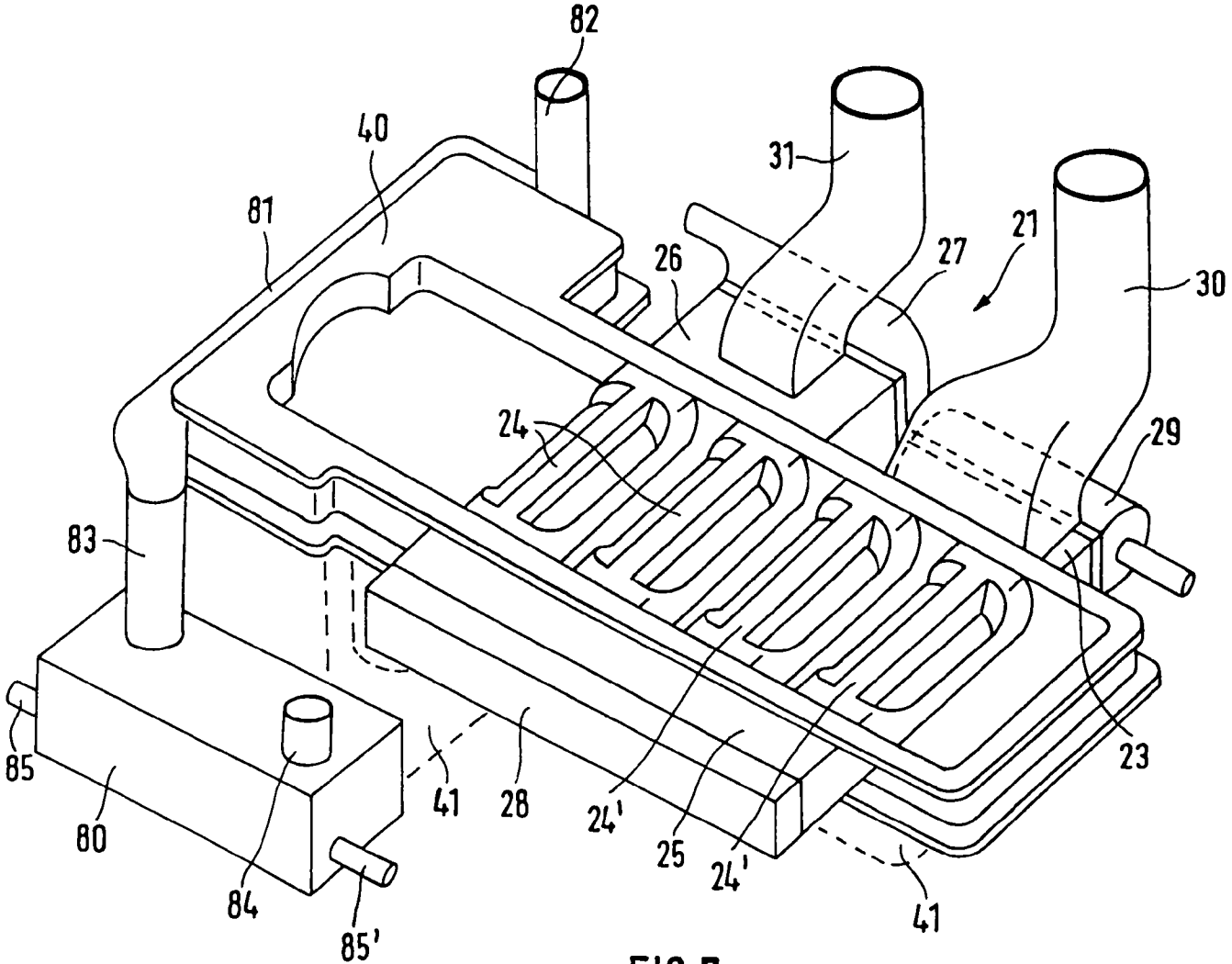
FIG. 7 shows a yoke plate having integrated charge air intermediate cooler in a perspective illustration.

A charge air intermediate cooler of the type described in FIG. 2 may also, as already noted above, be integrated in a yoke plate. FIG. 7 shows an arrangement of this type in a perspective illustration. The construction of the charge air intermediate cooler is identical to that described in connection with FIG. 2, so that the corresponding reference numbers are taken from FIG. 2 and reference is made to the description of FIG. 2 in regard to construction and mode of operation, only the deviations from the example according to FIG. 2 being explained in greater detail in the following. The arrangement illustrated in FIG. 7 shows a yoke plate 40 which is implemented as a ladder frame, the charge air pipes 24, 24' implemented in one piece with the yoke plate 40, which provide a connection from a first long side of the yoke plate 40 to its second long side, assuming the function of the crosspieces which stiffen the ladder frame. Analogously to the illustration in FIG. 2, the charge air supply connecting part 23 having charge air supply line 30 and coolant outflow chamber 29 positioned thereon as well as the charge air discharge connecting part 26 having charge air discharge line 31 and coolant inflow chamber 27 positioned thereon are located on the first long side of the yoke plate 40. Also analogously to the example according to FIG. 2, the charge air collection chamber 25 and the adjoining coolant collection chamber 28 are positioned on the second long side of the yoke plate 40 to produce the connection between the charge air pipes 24, 24'. The cooling inserts are located in the charge air pipes 24, 24', as described in connection with FIGS. 2 through 5. The charge air guiding and the guiding of the coolant corresponds to the example described according to FIG. 2, so that reference is made to the corresponding parts of the description in this regard.

An oil sump 41 (shown with dashed lines), which forms the crankcase lower part together with the yoke plate 40, adjoins the yoke plate 40 on the bottom to receive the lubricant required for the engine lubrication.

Furthermore, in the example according to FIG. 7, an intercooler 80 positioned laterally to the oil sump 41 on the second long side of the yoke plate 40 is provided. To connect the intercooler 80 to the high-pressure compressor (6" FIG. 1) placed on the first side of the yoke plate 40, a further charge air pipe 81 is integrated into the yoke plate 40 leading from its first long side to its second long side. The charge air flows from the high-pressure compressor via a connection line 82 to the further charge air pipe 81, and an attachment pipe 83 to the intercooler 80 and therefrom via a pipe line 84 to the intake pipe (10 FIG. 1). The intercooler is incorporated into a coolant loop (not shown) via coolant connections 85, 85".

Figure 8:
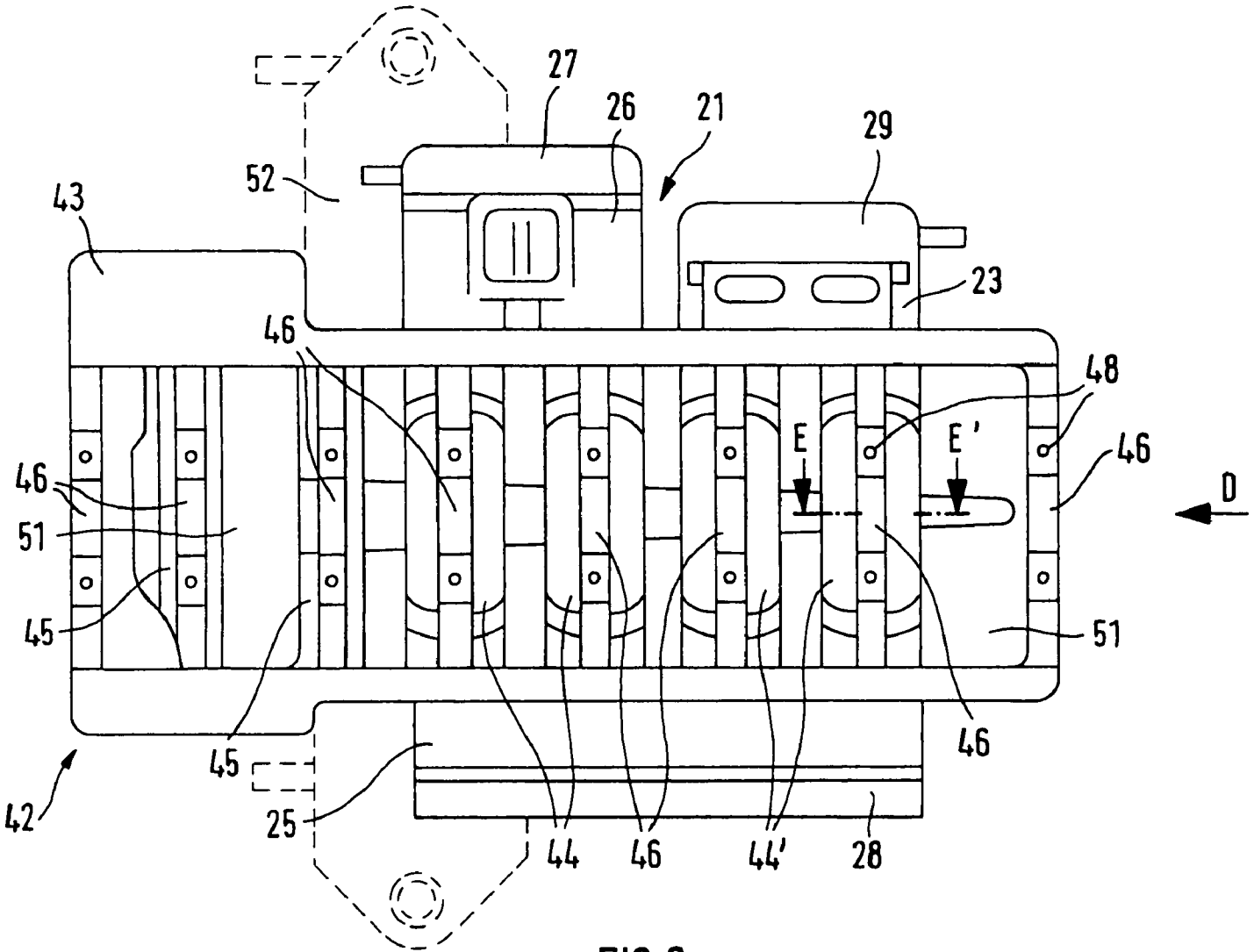
FIG. 8 shows a bearing plate having integrated charge air intermediate cooler in a top view.
Figure 9:
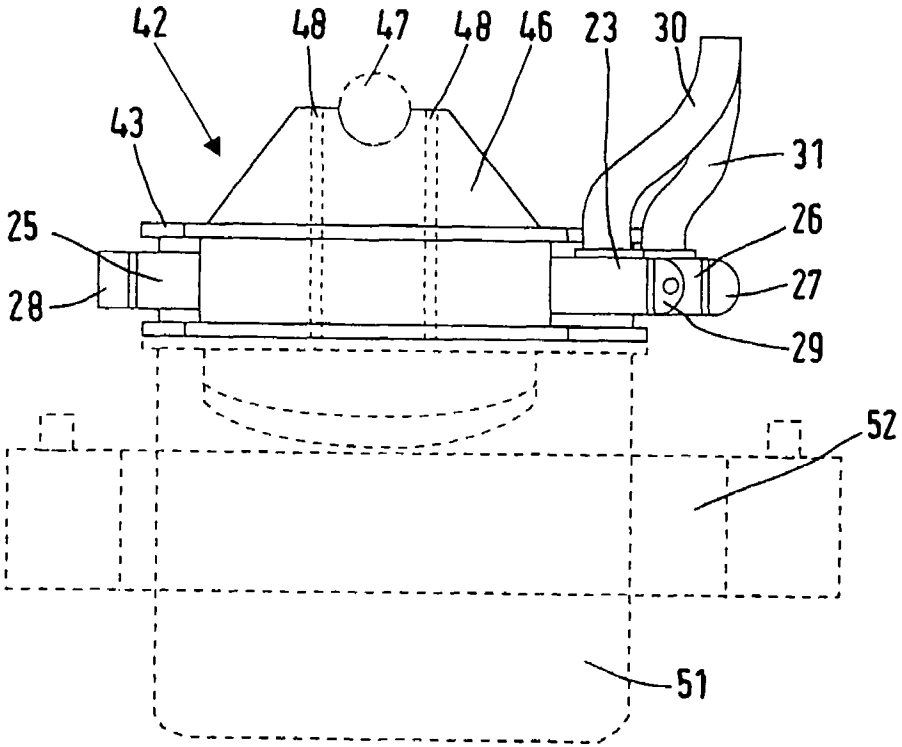
FIG. 9 shows the bearing plate from FIG. 8 in a side view.

A further alteration of the arrangement according to the present invention is shown in FIGS. 8 and 9. The plate illustrated there, which is implemented in the form of a ladder frame, is embodied as a bearing plate. Bearing plates or also bed plates of this type form, as already noted at the beginning, a module which assembles the bearing covers for the crankshaft bearings into one component in such a way that these may be mounted in one work step. FIG. 8 shows the arrangement in a top view, FIG. 9 shows the side view in the viewing direction corresponding to the arrow identified by "D" (FIG. 8).

The bearing plate 42 comprises a peripheral frame 43, which has transverse struts, which are formed by charge air pipes 44, 44' and, in addition, by bearing cover carriers 45. Bearing covers 46 are positioned on the peripheral frame 43, the bearing cover carriers 45, and the charge air pipes 44, preferably implemented in one piece therewith, which extend out of the plane formed by the peripheral frame 43 in the direction toward the crankshaft 47 (shown by dashed lines in FIG. 9). The bearing covers 46 each form one half of the crankshaft bearings, the respective other halves are positioned on the crankshaft upper part (not shown).

In this example as well, a charge air intermediate cooler 21 is used, which corresponds in its essential constructive features to the charge air intermediate cooler described in the example according to FIG. 2, so that the reference numbers from FIG. 2 are also taken in the example shown in FIGS. 8 and 9 in regard to the charge air intermediate cooler where there is constructive correspondence and reference is made to the corresponding description parts of this example in regard to the implementation and function. The charge air pipes 44, 44' deviate from the embodiment according to FIG. 2 and/or FIGS. 4 and 5 in that the bearing covers 46 are positioned on the charge air pipes 44, 44' and screw holes 48 for attaching the bearing covers 46 to the bearing block (not shown) are provided therein.

Figure 10:
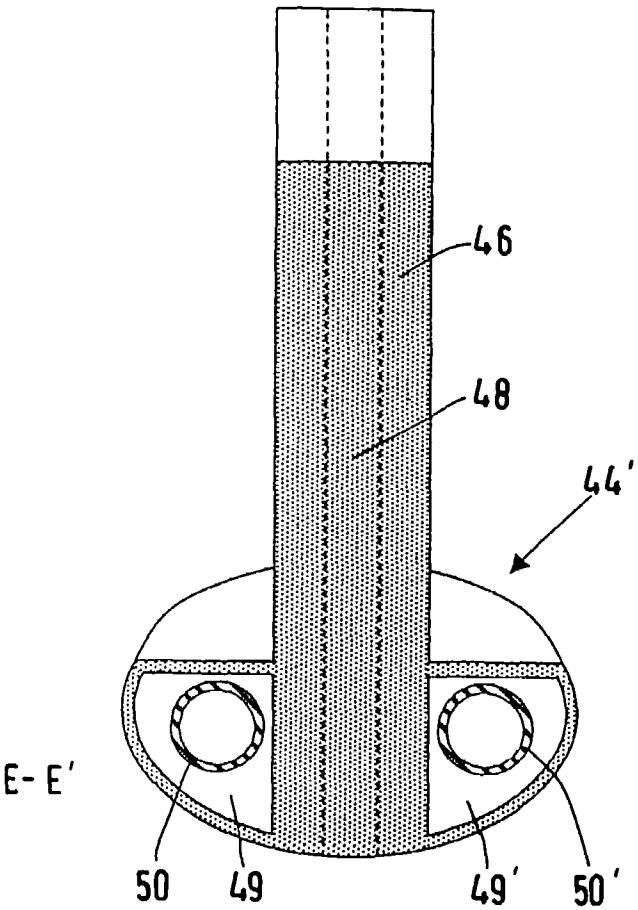
FIG. 10 shows a sectional illustration along the line E-E' in FIG. 8.

FIG. 10 shows an example of the construction of the charge air pipes 44, 44'. In this sectional illustration along line E-E' (FIG. 8), the charge air pipe 44' is shown in section transversely to its longitudinal extension. A bearing cover 46 is implemented in one piece with the charge air pipe 44' and divides the inner chamber of the charge air pipe 44' into two drafts 49, 49', each of which is penetrated by a coolant pipe 50, 50'. The drafts 49, 49' have the charge air flow through them, while the coolant pipes 50, 50' have coolant flowing through them, preferably in counterflow to the charge air.

To receive the lubricant required for the engine lubrication, an oil sump 51 adjoins the bearing plate 42 on the bottom, which forms the crankcase lower part together with the bearing plate 42. An intercooler 52 may be positioned on the oil sump 51, as shown by dashed lines in FIGS. 8 and 9.

Figure 11:
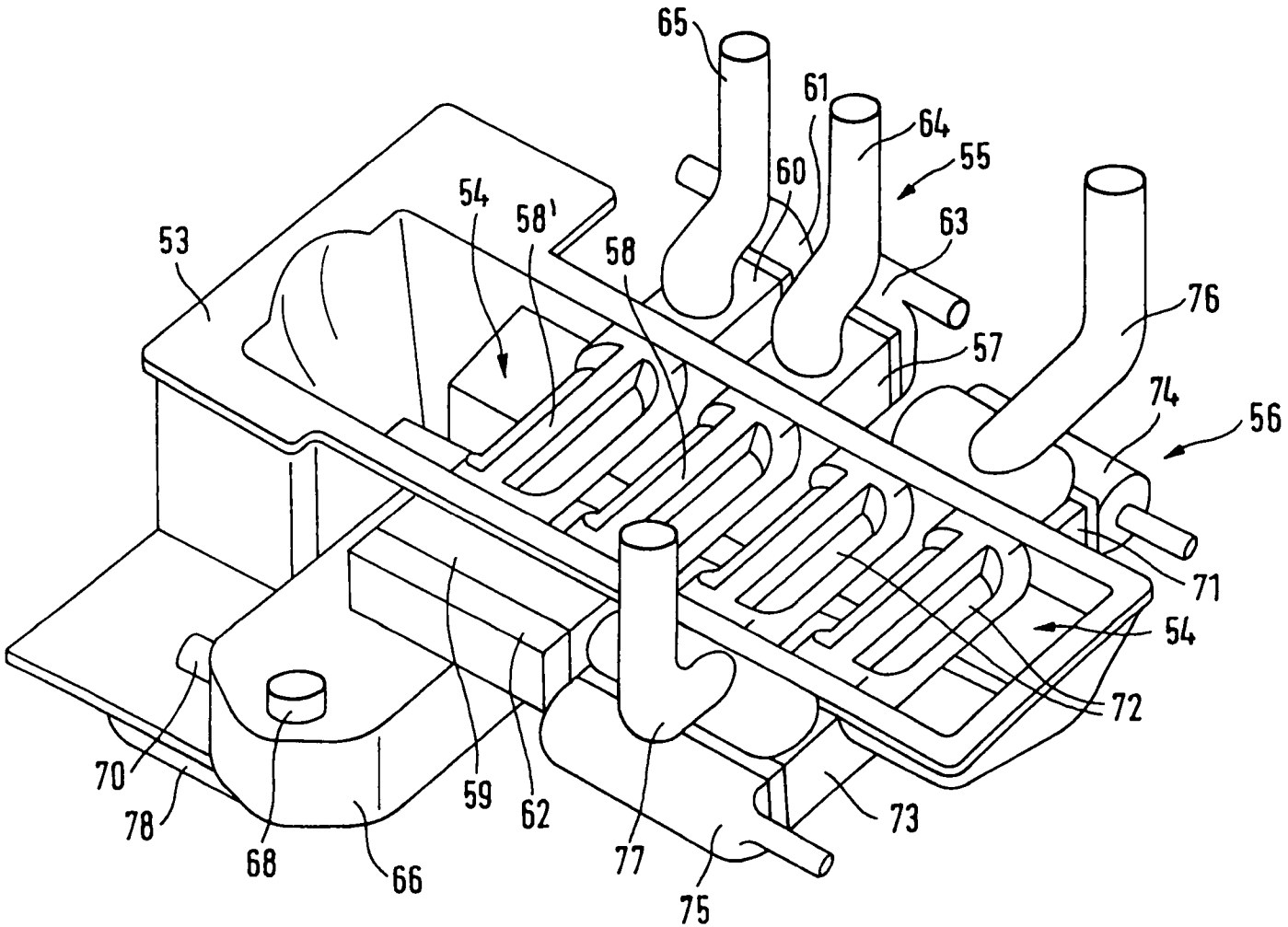
FIG. 11 shows a yoke plate having integrated inter-cooler, charge air intermediate cooler, and EGR cooler in a perspective illustration

FIG. 11 shows a perspective illustration of a possibility for integrating a charge air intermediate cooler, an intercooler, and an EGR cooler in the crankcase lower part. An intercooler 66, a charge air intermediate cooler 55, and an EGR cooler 56 are positioned on a yoke plate 53, which also forms an oil collection chamber 54. The charge air intermediate cooler 55 essentially comprises a charge air supply connecting part 57 positioned on a first long side of the yoke plate 53, from which a charge air pipe 58 guiding the charge air leads to the second long side of the yoke plate 53. A charge air overflow chamber 59 is positioned on the second long side, which connects the charge air pipe 58 to a charge air pipe 58', which returns to the first long side of the yoke plate 53 starting from its second long side, where it discharges into a charge air discharge connecting part 60.

A first cooling insert—not visible in FIG. 11—is located in the interior of the charge air pipe 58', which connects a coolant inflow chamber 61 positioned on the first side of the yoke plate at the charge air discharge connecting part 60 to a coolant overflow chamber 62 on the diametrically opposite second long side of the yoke plate 53. From this coolant overflow chamber 62, a second cooling insert—also not visible in FIG. 2—leads in the interior of the charge air pipe 58 back to a coolant outflow chamber 63 positioned on the first side of the yoke plate at the charge air supply connecting part 57.

Through the arrangement described above, the charge air compressed by the low-pressure compressor (7" FIG. 1) flows via a charge air supply line 64 into the charge air supply connecting part 57 and, via this and the charge air pipe 58, into the charge air overflow chamber 59. From there, the charge air reaches the high-pressure compressor (6" FIG. 1) through the charge air pipe 58', the charge air discharge connecting part 60, and a charge air discharge line 85. The charge air is cooled in the counterflow principle in that coolant from a cooling system (not shown) flows via the coolant inflow chamber 61 to the first cooling insert and to the coolant overflow chamber 62 and the second cooling insert to the coolant outflow chamber 63 and from there returns into the cooling system.

The intercooler 66 shown in FIG. 11 is used, as already described in connection with FIG. 1, for cooling the charge air compressed again by the high-pressure compressor (6" FIG. 1) and heated at the same time. The intercooler 66 is positioned below the oil collection chamber 54 on the yoke plate 53 in such a way that it leads from the first long side of the yoke plate 53 under it through to the second long side of the yoke plate 53. The charge air provided by the high-pressure compressor (6" FIG. 1) is supplied on the first long side of the yoke plate to the intercooler 66 via a charge air connection (not visible) and, through this, reaches the second long side of the oil sump, where a charge air discharge 68 is positioned on the intercooler 66, from which the charge air reaches the intake pipe (10 FIG. 1) via a connection part (not shown). A heat exchanger through which coolant flows is positioned in the intercooler 66, which is connected via a coolant supply (not visible) and a coolant drain 70 to a cooling system (not shown).

In addition to the charge air intermediate cooler 55 and the intercooler 66, an EGR cooler 56 is positioned on the yoke plate 53, whose object is to cool the exhaust gas recirculated by the exhaust gas header pipe (5 FIG. 1) to the intake pipe (10 FIG. 1) enough that the exhaust does not noticeably influence the charge air temperature in the intake pipe (10 FIG. 1). The EGR cooler 56 comprises an EGR supply connecting part 71 positioned on the first long side of the yoke plate 53, from which two exhaust pipes 72, which guide the exhaust gas to be recirculated, lead to the second long side of the of plate 53, where they open into an EGR exhaust connecting part 73.

Cooling inserts—not visible in FIG. 11—constructed analogously to the illustrations in FIGS. 4 and 5 are located in the interior of the exhaust pipes 72, which connect an outflow chamber 74 positioned on the first side of the yoke plate 73 at the EGR supply connecting part 71 to an inflow chamber 75 positioned on the diametrically opposite second long side of the yoke plate 53 at the EGR exhaust connecting part 73.

Through the arrangement described above, exhaust gas to be recirculated by the exhaust gas header pipe (5 FIG. 1) flows via an EGR supply line 76 into the EGR supply connecting part 71 and via this and the exhaust pipes 72 into the EGR exhaust connecting part 73 and an EGR return line 77 to the intake pipe (10 FIG. 1). The recirculated exhaust gas is cooled in the counterflow principle in that coolant from a cooling system (not shown) flows via the inflow chamber 75 and the cooling inserts (not visible) to the outflow chamber 74 and from there returns into the cooling system.

The arrangement described above is terminated on the bottom by an oil collection sump 78 and forms the crankcase lower part together with it.

Proceeding from the examples described above, numerous alterations may be conceived, which may be derived without difficulty from the above description and knowledge typical for one skilled in the art without leaving the basic inventive idea, these embodiments thus only having exemplary character. In particular, manifold alterations suggest themselves for the cooling principle. Thus, in particular, the cooling principle of the charge air guided in an external pipe and/or the recirculated exhaust gas through a cooling insert positioned in the external pipe may be reversed in such a way that the charge air and/or the exhaust gas to be recirculated is guided in an internal pipe and cooled by mantle cooling between an external pipe and the internal pipe. Furthermore, the counterflow principle selected for the above examples is only one of many possibilities; parallel flow, transverse flow, reverse flow, or mixed variations may also be used, of course. How the arrangement is implemented in practice is a question of the quantity of heat to be transferred and thus the layout of the arrangement. This layout is in turn familiar for one skilled in the art.

To improve the cooling effect of the arrangement further, the possibility exists of providing the partition walls between the coolant and the charge air, and/or the exhaust gas to be recirculated, with a macrostructure in order to enlarge the area available for cooling. A macrostructure is understood in this case as multiple protrusions and/or depressions which are distributed over the partition walls uniformly or randomly.

The arrangement may also be altered so that the pipes which the charge air flow through are divided into multiple parallel chambers. There is also the possibility of providing multiple drafts for the areas which coolant flows through. The arrangement according to the present invention may be produced especially favorably through casting from aluminum or cast iron.

The fact that only in-line engines are used in the examples to explain the present invention does not indicate any type of restriction; the arrangement according to the present invention is also obviously suitable for internal combustion engines having banks of cylinders arranged in V-shapes.

The specification incorporates by reference the disclosure of Austrian priority document AT 685/2005 filed Apr. 25, 2005.

The present invention is, of course, in no way restricted to the specific disclosure of the specification and drawings, but also encompasses any modifications within the scope of the appended claims.

The invention claimed is:

1. A supercharged internal combustion engine comprising:

a crankcase lower part extending about a space below a crankshaft;

a crankcase upper part;

at least one intercooler cooling charged air from a first compressor by coolant;

a charge air intermediate cooler cooling charged air from a second compressor by coolant;

a plate that adjoins the crankcase upper part;

wherein said at least one intercooler and/or said charge air intermediate cooler is integrated and secured to said plate, and an oil sump that adjoins said plate and together therewith forms said crankcase lower part.

2. A supercharged internal combustion engine according to claim 1, wherein said intercooler and/or charge air intermediate cooler is at least partially monolithically formed with said plate; wherein said plate is a yoke plate.

3. A supercharged internal combustion engine according to claim 1, wherein said intercooler and/or charge air intermediate cooler is at least partially monolithically formed with said plate; wherein said plate is a bearing plate.

4. A supercharged internal combustion engine according to claim 1, wherein said intercooler and/or charge air intermediate cooler contains a first chamber that guides the coolant, and a second chamber that guides the charge air and is closed off relative to said first chamber, wherein said first chamber is incorporated into a coolant circuit via a coolant inflow and a coolant outflow, and wherein said second chamber communicates via a charge air supply line with the pressure side of a compressor that provides the charge air, and communicates via a charge air discharge line with a charge air header pipe or with the intake side of a further compressor.

5. A supercharged internal combustion engine according to claim 1, wherein a wall separates said first chamber from said second chamber and has a maximized heat exchanger surface.

6. A supercharged internal combustion engine according to claim 1, wherein said intercooler and/or said charge air intermediate cooler is tubular.

7. A supercharged internal combustion engine according to claim 6, wherein said intercooler and/or said charge air intermediate cooler is formed from an outer tube, through which charge air flows, and a cooling insert, through which the coolant flows, or wherein said intercooler and/or said charge air intermediate cooler is formed from an outer tube, through which the coolant flows, and an insert, through which charge air flows.

8. A supercharged internal combustion engine according to claim 7, wherein said outer tube is secured to the plate.

9. A supercharged internal combustion engine according to claim 7, wherein said outer tube is monolithically formed with the plate.

10. A supercharged internal combustion engine according to claim 1, wherein the internal combustion engine is provided with exhaust gas recirculation, and wherein for cooling recirculated exhaust gas, an exhaust gas recirculation cooler, which is cooled by a coolant, is integrated into said crankcase lower part.

11. A supercharged internal combustion engine according to claim 1, wherein at least one charge air pipe is integrated into said crankcase lower part such that said at least one charge air pipe leads from a first side of said crankcase lower part to a second side thereof.

* * * * *